United States Patent [19]

Taylor et al.

[11] Patent Number: 4,709,686

[45] Date of Patent: Dec. 1, 1987

[54] AIR WEAPON WITH GAS-TIGHT EXPANSION CHAMBER

[75] Inventors: Hugh F. Taylor, Sawston; David R. Theobald, St. Ives, both of United Kingdom

[73] Assignee: Utec B.V., DeLeersum, Netherlands

[21] Appl. No.: 552,457

[22] Filed: Nov. 16, 1983

Related U.S. Application Data

[63] Continuation-in-part of Ser. No. 357,331, Mar. 11, 1982, abandoned.

[30] Foreign Application Priority Data

Oct. 1, 1980 [GB] United Kingdom ..... 8031687
May 14, 1981 [GB] United Kingdom ..... 8114842

[51] Int. Cl.[4] ..... F41B 11/00
[52] U.S. Cl. ..... 124/67; 417/555 R
[58] Field of Search ..... 124/61, 66, 67, 68, 124/69, 70; 417/555 R

[56] References Cited

U.S. PATENT DOCUMENTS 2,572,176 10/1951 Mihalyi ..... 124/67
2,924,211 2/1960 McSwain ..... 124/61
3,308,803 3/1967 Walther ..... 124/69
3,924,599 12/1975 Hammond ..... 124/67
4,282,852 8/1981 Omana ..... 124/67

FOREIGN PATENT DOCUMENTS 132086 7/1902 Fed. Rep. of Germany ..... 124/66
1428628 10/1970 Fed. Rep. of Germany ..... 124/69
1423153 1/1976 United Kingdom ..... 124/67

*Primary Examiner*—Richard T. Stouffer
*Attorney, Agent, or Firm*—Lee, Smith & Zickert

[57] ABSTRACT

An air rifle having a firing mechanism (12) which comprises a variable volume gas chamber (52) behind a piston (28) which moves within an outer cylinder (26) in front of a rear cylinder (36). The gas chamber (52) is defined between the piston and the rear cylinder and is sealingly closed. When the rifle is cocked, the piston is latched in its most rearward position in which the gas in the chamber (52) is most highly compressed. The trigger releases the piston latch, causing the piston to be driven forward as the gas expands in the variable volume chamber compressing the air in the outer cylinder (26) in front of the piston (28) until it exceeds a threshold which fires the pellet out of the breech. The semi-permanent charge of gas in the chamber (52) thus constitutes a pneumatic spring. A safety device is provided to relieve pressure in the chamber (52) before the firing mechanism can be dismantled.

11 Claims, 5 Drawing Figures

AIR WEAPON WITH GAS-TIGHT EXPANSION CHAMBER

This is a continuation-in-part of application Ser. No. 357,331, filed Mar. 11, 1982, now abandoned.

DESCRIPTION

1. Field of Invention

This invention relates to air guns.

2. Background to the Invention

The three basic types of air gun may be classified according to their respective firing mechanisms. Thus there are pump type guns, gas operated guns and spring guns. The present invention concerns a development of the spring type of air gun.

In many examples of this type of air gun, a steel cylinder (normally about three centimetres by thirty-five centimetres long) is the basis of the firing mechanism. The barrel is hinged to the front of the cylinder to enable the breech to be opened and when the breech is opened, a cocking mechanism acts on a solid piston slidable within the cylinder to drive the piston rearwardly and compress a coil-type firing spring. The firing mechanism is latched by a trigger mechanism in the rearward position in which the firing spring is fully compressed. With a pellet inserted in the breech and the latter closed the gun is ready to fire. A pull on the trigger releases the latched firing mechanism so that the piston is driven forwardly at high speed under the action of the firing spring. The air in the cylinder in front of the piston is increasingly compressed to exceed a threshold at which the pellet is ejected through the barrel at high speed.

The average marksman, for example using an air rifle of this type both for target shooting and for shooting live quarry such as rabbits, vermin and birds such as pigeons, will quite easily use between 4,000 and 6,000 pellets in one year. During such a period of shooting, assuming that it is a new gun, there will be an initial "tuning-up" period at which time adjustments to the sights, often of a telescopic nature (and commonly called "zeroing the scope") will involve the use of up to say 500 pellets. During this time the owner of the gun will also make an assessment of the type of pellet he wishes to use, and this in itself can necessitate variations in calibration of the sights, since the weight and design of pellet from one make to another can affect the pellet velocity. On the assumption that the gun, and therefore its coiled-compression spring are new, this initial "tuning period" can have several effects. Firstly, the other moving parts of the gun can begin to get "bedded-in" e.g. the piston seals can free-up slightly which will tend to increase pellet velocity. This, in the initial period of use of the new gun, tends to be balanced by the loss of power which always occurs with the mechanical or coil spring even over the first 500 to 1,000 shots. A gun which is designed, for example to produce an energy level at the muzzle of just below 12 ft lbs (the maximum limit for unlicensed air guns in the U.K.) will already suffer a drop in performance of the order of 5 to 10% of the peak energy. Continued use of the gun, after this initial period does not tend to produce such a rapid deterioration in performance, but after say 3,000 shots from a new gun there tends to be a further gradual but steady deterioration in spring performance.

The springs of these guns are generally manufactured from high quality round steel wire, which has previously been hardened and tempered and after winding the spring is stressed-relieved at low temperatures for several hours before testing. When this type of coil spring is compressed, the energy is in fact stored by the wire of the spring twisting but it is well known that repeated compression and release of this type of spring several thousand times results in a loss of spring performance, primarily due to a reduction in spring length, for example due to deterioration of either the whole of the spring, the result of which the pitch of the coils change, or perhaps a localised collapse of a few coils.

From the point of view of the user of the gun, this deterioration is gradual, and while it can to some extent be countered by resetting the sights, and this may be adequate for short range stationary target shooting even where the loss of efficiency is considerable, serious loss of power due to spring shortening seriously affects the use of a rifle when employed for live quarry shooting where the target distance may be considerably greater.

As a result of these well recognised problems with a coil spring, a keen marksman will re-spring his gun, i.e. replace his spring, for example at the beginning of a shooting season, and marksmen who use a very large number of shots will perhaps regularly re-spring their guns at three monthly intervals, which is naturally a costly and time consuming task to say nothing of the gradual loss of power even during those three months periods.

It is also well known that owners of this type of gun, when used for shooting live quarry, desirably would like to maintain the gun cocked and ready for instant use, but this can mean a long cocked period of up to say half an hour or more which, if regularly carried out, tends prematurely to affect the coil spring efficiency. As a consequence the gun user tends to release the main coil spring of the gun and not have it readily cocked as often as he would desire when shooting live quarry. There has thus clearly been a demonstrable need for a gun which can be left cocked indefinitely without loss of spring efficiency.

Another problem which is not uncommon is that spring breakage can occur, for example due to incorrect tempering of the high tensile wire used for producing the springs.

These well recognised problems with compression coil spring air guns have clearly indicated a long felt need for a more constant and long-lived power source and it is believed that guns in accordance with the present invention, now marketed in significant numbers by the Applicants, have proved in the field to be greatly superior to their predecessors. For example in an article in "Air Gun World" of November 1982 at pages 22/23 there is an article by Geoffrey Boxall who discusses the "Theoben Sirocco Rifle", made by the Applicants in accordance with the present invention, and in this article Mr. Boxall said:

> "The accuracy compared well with any other sporting rifles I've tested according groups of one inch or less at 30 yards. Two great advantages of the Sirocco over other air rifles are the consistency and reliability of its power source . . . "

This independent assessment accords with the inventor's experience where rifles made in accordance with the present invention, after initial "tuning" have each fired at least 15,000–20,000 pellets without any appreciable loss of efficiency or escape of the gas charge in the gas spring.

Prior art

An example of a coil spring type weapon is described in UK Patent No. 1423153 (WACKROW et al). This comprises a hollow cylindrical chamber having a smooth internal bore and a cylindrical piston slidably displaceable within the cylindrical chamber and having a piston head or crown mounted at the end which is nearer to the breech into which a pellet can be fitted. The cylindrical piston to the rear of the piston head or crown serves as an outer guide for a compression spring which is located within the piston between the rear of the piston head at one end and rear of the cylindrical chamber at the other.

A stationary inner spring guide extends axially within the rear portion of the cylindrical piston and is secured to the rear end of the chamber, forming an annular space within which the spring is located.

The interior of the piston is vented to atmosphere through a slot in the wall of the piston which communicates with a similar slot in the wall of the chamber. The two slots provide access for the latching mechanism for holding the piston sleeve in a cocked position prior to firing.

The piston head includes peripheral sealing so that, on release of the latching mechanism, the stored energy in the spring causes air ahead of the piston to be compressed as aforesaid so that the pellet is ejected.

It is to be noted that immediately prior to firing, immediately afterwards, and during periods when the gun is not in use the air pressure on the two sides of the piston head is essentially the same (normally atmospheric). Consequently the only force acting on the piston upon firing is the stored energy in the coil spring.

In other words this construction is typical of many hundreds of designs of spring-air guns, in which a mechanical compression spring is employed as the sole means for moving a piston to compress air within a compression chamber immediately behind the breech. As has been discussed above such guns can be very accurate but a mechanical spring of this type inevitably suffers from fatigue after continued use with consequent loss of power and therefore pellet velocity.

U.S. Pat. No. 4,282,852 to Omana describes a ost complex weapon in which a form of air spring is incorporated which is formed by a pair of concentric stationary cylinders in which a charge of pressurised gas is introduced via a valve. The inner cylinder contains a solid piston which, when cocked is drawn to the rear of the inner cylinder, but can be released so as to permit the piston to accelerate under the action of the compressed air to force a charge of air ahead of the piston within the inner cylinder towards the breech, thereby to expel the pellet located therein. However, such an arragement suffers from certain disadvantages. Firstly, in this arrangemet, cocking is achieved by reciprocating the barrel itself in order to cause the barrel to bear on the crown of the piston to retract it to its cocked position. This necessitates annular seals between the sliding surfaces of the barrel and the remainder of the gun, and also a locking device to hold the barrel securely in position when withdrawn after cocking.

A further significant disadvantage of this construction is that the provision of a pair of concentric cylinders, within which the gas charge is contained, necessitates the latching mechanism passing from the exterior of the outer cylinder through both cylinders in order to latch the cocked solid piston. Clearly, with such an arrangement, retraction of the piston during cocking cannot be achieved from the exterior of the cylinders as a consequence of which the barrel cocking method is employed. The very complex latching and cocking structure which results involved not only the barrel sealing and cocking method referred to above, but intricate sealing between the trigger mechanism and the outer of the two cylinders containing the gas charge.

Furthermore, with the Omana design, the solid piston has a pair of O rings in its circumference which engage the interior of the bore of the inner cylinder and these O rings are intended not only to preserve the integrity of the gas compression chamber to the rear of the piston during firing but also permanently to prevent leakage of the charge of gas in the pair of cylinders past the piston to what is normally atmospheric pressure on the other side of the crown of the piston. In other words a single sealing arrangement is provided on the piston for these two purposes. In this Omana design O ring seals are used which are under continuous pressure from the gas charge. It is believed that this would provide a serious drawback in this design since an O ring, by its very nature, can only have a limited and constant force fit between the parts it is intended to seal—in this case between the solid piston and the inner cylinder. Any increase in sealing force would significantly affect piston, and hence pellet, velocity. It is well known that O ring seals require high radial pressure if they are to maintain a constant seal under pressure and it is believed that this could not be achieved satisfactorily in a gun design where it is intended to have a permanently pressurised gas charge which will not leak and thereby maintain a constant firing velocity. It is thus believed that with the Omana design leakage would be inevitable, leading to a loss of efficiency and consequent deterioration in the calibration of the gun and eventual need for a fresh gas charge.

A further disadvantge of the complex structure of Omana is that assembly and disassembly (for example for servicing) both of the internal mechanisms themselves, and into the remainder of the stock and/or butt of the weapon, would be extremely difficult and time consuming. U.S. Pat. No. 3,308,803 to Walther describes a further gun of air operated type which can be generally said to fall under the classification of pump-up guns, there being no permanent pressurised gas charge for firing purposes. Walther has exercised considerable ingenuity to produce a cocking mechanism using two stages of compression which rely on the sliding of a hollow piston containing a one way valve assembly. On firing, like other conventional pump-up guns, there is no piston movement whatsoever, the whole charge of high pressure gas in front of the piston being released by a valve to the rear of the pellet to fire it. The two stages of compression in Walther rely on the sliding of a hollow piston containing a one way valve assembly and it will be observed that lip seals have been used. It should be noted however that the lip seals are only subjected to very low relative speeds of movement since the only relative movement which occurs between the sliding members in the two stages of compression gun is during the cocking action. No movement of a piston relative to a cylinder occurs during the firing of the weapon as in the two previous prior art designs referred to, and its bounding cylinder. Thus Walther does not disclose the use of a lip seal oriented to take advantage of its sealing ability and yet provide a seal capable of very high sliding speeds. Furthermore Walther does not disclose a stationary lip seal.

OBJECTS OF THE PRESENT INVENTION

It is accordingly a principal object of the present invention to provide an air weapon which will overcome or alleviate the disadvantages of the prior art arrangements referred to above.

It is a further object of the present invention to provide an air weapon of simple robust construction and which provides for extreme consistency over extensive use.

SUMMARY OF THE PRESENT INVENTION

The present invention provides an air weapon in which a pellet or other projectile is expelled from a barrel by compressed air, the air being compressed by a hollow moving piston which moves under the influence of a gas spring.

According to a specific arrangement the present invention provides an air weapon in which a pellet is expelled from a barrel of air compressed within a compression chamber, the weapon including a two-part gas spring comprising first and second telescopically arranged gas cylinders the interiors of which are in communication with one another and which together form an expansion chamber capable of being permanently filled with a charge of compressed gas, the first of the gas cylinders being stationary and the second of the gas cylinders comprising a moving piston having a closed end to form a piston crown remote from the first gas cylinder, the piston crown partially forming the compression chamber, and cocking means arranged to move the second of the gas cylinders from an uncocked condition to a cocked condition in a direction further to compress the charge of compressed gas.

Specifically an outer main cylinder may be included having a bore within which the second gas cylinder is reciprocally mounted, first seal means disposed between the crown and the bore of the outer main cylinder, and second seal means disposed between the first and second gas cylinders to retain the charge of compressed gas in the compression chamber.

The outer main cylinder may have a bore within which the second gas cylinder is reciprocally mounted, first seal means being disposed between the crown and the bore of the outer main cylinder and second seal means disposed between the first and second gas cylinders, the first and second seal means together isolating the compression chamber from the expansion chamber by defining an intermediate air zone which is normally at atmospheric pressure in both said cocked and uncocked conditions of the weapon, as well as during firing.

It is found particularly desirable for the second seal means to include an annular lip seal which is arranged to be biassed in a sealing direction against one of the first and second gas cylinders by the charge of compressed gas. Preferably the annular lip seal is stationarily mounted on the exterior of the first gas cylinder and engages a bore of the second cylinder. In this case the second seal means may also include an O-ring seal stationarily mounted on the exterior of the first gas cylinder and engaging the bore of the second cylinder, the O-ring seal being spaced from the annular lip seal on its side remote from the expansion chamber. It may be desirable for a small amount of grease or other lubricant to be disposed between the lip seal and the O-ring seal.

The outer main cylinder may have forward, central and rear zones, the forward zone defining the compression chamber, the piston crown being positioned, in the cocked condition of the gun, at an interface between the forward and central zones, and the first of the gas cylinders being located in the rear zone with the second seal means stationarily disposed at the forward end of the first gas cylinder at an interface between the central and rear zones, the outer main cylinder defining a cylindrical wall which is unbroken in the forward zone but which has a longitudinal aperture therethrough in the central zone, the second gas cylinder having a cylindrical unbroken wall in the region thereof which, in the cocked or uncocked conditions of the weapon, is in axial alignment with the forward or central zones, a cocking abutment being located on the exterior of said cylindrical unbroken wall of the second gas cylinder, said cocking abutment extending through said longitudinal aperture in the wall of the outer main cylinder for engagement by said cocking means, and said second gas cylinder having a wall portion disposed to the rear of said cocking abutment, said wall portion being reciprocally mounted within a part of said bore of the outer main cylinder in said rear zone.

According to another aspect of the present invention an air weapon in which a projectile is expelled from a barrel by a charge of compressed air expelled from a compression chamber includes a gas operated piston arrangement comprising an outer main cylinder having a bore, a main piston having a crown which partially defines the compression chamber, the main piston being reciprocally mounted within the bore of the outer main cylidner, first seal means carried by the crown of the main piston and arranged to seal between the crown and the said bore, the main piston being formed by a second cylinder closed at one end by the crown, and which reciprocates with respect to a second, stationary, piston, second seal means being provided between the main and second pistons permanently to retain a charge of pressurised gas within the main piston, such charge of gas being capable of further pressurisation by cocking of the weapon caused by reciprocal movement of the main piston towards the second piston.

According to yet another aspect of the present invention in an air weapon a projectile is expelled from a barrel by a charge of compressed air produced by movement of a gas operated piston arrangement comprising an outer cylinder having a bore, a piston having a crown sliding in said bore, first seal means being disposed between the crown of the main piston and said bore, the piston being formed by a second cylinder having a peripheral gas-tight wall which is closed at one end by the crown and having its other end open, the main piston co-operating with a stationary part with respect to which it can reciprocate through said open end, and second seal means being provided which coacts between the second cylinder and said stationary part permanently to retain a charge of pressurised gas within said piston such charge of gas being capable of further pressurisation by cocking of the weapon caused by a cocking movement of the main piston.

In yet another aspect of the present invention in an air weapon in which a projectile is expelled from a barrel by a charge of compressed air expelled from a compression chamber, the weapon includes an outer main cylinder having a bore, a gas spring disposed within the bore, the gas spring being formed by first and second parts adapted to reciprocate with respect to one another, the first part comprising a main piston having a crown, first seal means being disposed between the crown of the main piston and the main cylinder bore, the main piston being formed by a second cylinder having a bore, the second part of the gas spring being formed by a third cylinder stationarily disposed at least partially within the outer main cylinder, the third cylinder extending within the bore of the second cylinder, stationary second seal means being provided on the exterior of the third cylinder to co-operate with the bore of the second cylinder permanently to retain a charge of pressurised gas disposed within the second and third cylinders, such charge of gas being capable of further pressurisation by cocking of the gun caused by movement of the second cylinder with respect to the third cylinder to reduce the combined internal volume of the second and third cylinder.

In yet another aspect of the present invention an air weapon has a barrel having an inner end, a breech disposed at said inner end of the barrel to contain a pellet, an outer main cylinder having a forward compression chamber and an output port communicating between the compression chamber and the breech, the outer main cylinder having a bore, an expansion chamber formed by first and second parts and containing a charge of pressurized gas, the first part comprising a hollow rearward part stationarily disposed within but spaced from a rearward section of the bore of the outer main cylinder to provide an annulus between said bore and said hollow rearward part, the second part comprising a forward hollow part forming a piston which is reciprocally mounted with respect to the hollow rearward part, the piston having a crown, first sealing means being provided between the crown and the bore of the outer main cylinder partially to define the forward compression chamber, and second sealing means being provided between the forward and rearward hollow parts for containing a permanent charge of compressed gas, the gun being capable of being cocked by manual movement of the forward part away from the breech to expand the forward compression chamber and simultaneously reduce the size of the expansion chamber further to compress the charge of compressed gas, a sear for engagement with a latching shoulder positioned on the forward hollow part the sear extending through a longitudinal aperture in the wall of the outer cylinder, and trigger means for releasing the sear from the latching shoulder thereby to permit high speed forward movement of the forward part caused by expansion of the permanent charge of pressurized gas within the expansion chamber thereby to compress air within the forward compression chamber to expel the pellet.

According to another aspect of the present invention an air weapon in which a projectile is expelled along a barrel by a charge of compressed air expelled from a compression chamber through a port, comprises in combination:

(a) a propulsion chamber within a first sleeve which is slidable relative to and closed by a stationary internal closure member the propulsion chamber containing a charge of pressurized gas;

(b) annular sealing means between the internal closure member and interior of the first sleeve, the annular sealing means being shrouded by the latter;

(c) a second sleeve closed at one end by a wall containing the said port and within which the first sleeve is slidably displaceable to define the said compression chamber, into which a charge of air can be drawn and from which air can be expelled through the said port;

(d) means for forcibly displacing the first sleeve towards the internal closure member to compress the pressurized gas to a higher pressure;

(e) latching means for retaining the first sleeve in the displaced position to maintain the said higher pressure until the weapon is to be fired, and (f) trigger means for releasing the latching means to cause the first sleeve to accelerate towards the said port and compress the charge of air in the compression chamber, thereby to expell a projectile from the port.

The invention thus provides a weapon in which the wall of the compression chamber containing the charge of air which on being compressed will eject the projectile, is separate and independent from the wall of a second chamber containing the charge of pressurized gas which when allowed to expand causes the charge of air to be compressed to fire the weapon. In this way the sealing of the charge of pressurized gas within the second chamber is totally independent of the external sealing of the movable member within the compression chamber which must be capable of rapid unimpeded forward movement to effect firing.

In a particularly preferred embodiment the sealing means is a soft lip ring seal, the annular lip of which engages the inside surface of a hollow cylindrical sleeve which is closed at one end and serves to protect the lip seal at all times.

Preferably the propulsion chamber is formed by the cooperation of a hollow piston slidable over an axially extending hollow sleeve having a lip seal at the end thereof always within the hollow piston (so as to be protected thereby and seal the chamber so formed to atmosphere) and the hollow piston is itself slidable within an outer sleeve and is sealed by an "O" ring seal within the outer sleeve and is slidable rearwardly to compress a charge of gas in the propulsion chamber. When permitted (on firing) the hollow piston can slide rapidly in the opposite forward direction to compress air in advance of the head of the piston, inside the outer sleeve, to effect firing of a projectile.

It will be seen that this arrangement effects total separation of the propulsion chamber and compression chamber, each being sealed relative to atmosphere and not directly sealed relative to one another. This is of considerable importance since it prevents any distortion of the lip seal as the charge of air in the compression chamber is elevated in pressure and which can otherwise result if the two chambers are separated by a movable solid piston having the lip seal there around.

In essence the present invention is based on the concept of replacing the conventional coil-type compression spring by a pneumatic spring and the means by which this concept can be realised. The invention provides advantages over the conventional spring type air rifle and also over those attempts to replace the conventional coil-type compression spring with pneumatic air springs already mentioned and referred to in the prior art. In particular the invention provides a weapon which has greater uniformity and consistency of firing power, greater reliability and a higher maintenance of performance with age.

The sealing means at the forward end of the inner cylinder ensures that gas in the variable volume space cannot leak past the outside of the piston towards the breech of the gun, thereby to escape when the weapon is fired. By providing a seal as aforesaid the charge of gas utilised for firing can be permanently retained within the weapon to maintain performance until deliberately released or reduced in pressure for example to enable maintenance or servicing.

Preferably a valve such as a Schraeder type valve is provided in the rear end closure through which the variable volume chamber can be charged with gas under high pressure or can be recharged in the unlikely event that the pressure becomes reduced for any reason.

Conveniently the rear closure is formed by a tailpiece on the inner cylinder which mates with the rear end of the outer cylinder on the interior thereof and is fixed in position by locking screws which are tightened in position through a metal bonding adhesive such as that known by the trade mark Loctite. By incorporating such a method of fixing together with a gas escape passage which communicates through the tailpiece between the interior of the inner cylinder and at least one of the screwholes in which the locking screws are received, gas is permitted to escape so as to avoid accidents when the firing mechanism is dismantled for cleaning or servicing. Preferably the gas escape passage communicates through the tailpiece between the interior of the inner cylinder and the majority of the screwholes if not all of the screwholes in which the locking screws are received.

By locating the annular lip seal between the front end of the inner cylinder and the inside of the closed front end of the hollow piston, the charge of highly pressurized gas within the variable volume chamber always acts in a manner to urge the periphery of the lip seal into contact with the inside of the hollow piston so that there is no tendency for the charge of highly pressurized gas to escape and furthermore the lip seal is configured as a trailing seal with regard to forward pellet firing movement of the hollow piston so that there is little tendency for the seal to jam or brake the forward pellet firing movement of the hollow piston.

DETAILED DESCRIPTION OF THE DRAWINGS.

Figure 1:
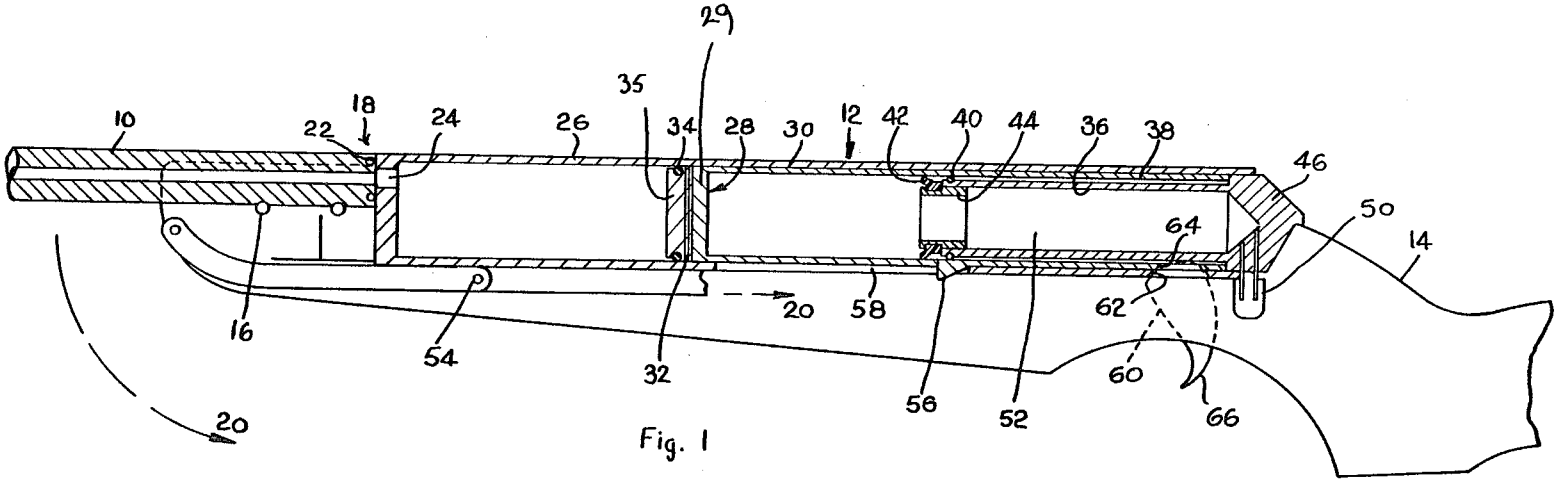
FIG. 1 shows the firing mechanism of an air rifle, in the cocked condition, in vertical cross-section.

The illustrated air rifle comprises a barrel 10 in front of a firing mechanism 12 mounted to the stock 14, the latter for convenience being shown only in FIG. 1. The barrel turns about a pivot pin 16 to open a breech 18, as indicated by arrows 20 in FIG. 1, and at the same time cocking the mechanism 12 ready for firing. The barrel 10 closes the breech 18 against a breech seal 22 in the form of an "O" ring. When the rifle is opened to effect cocking, a pellet is inserted in the breech 18 in accordance with conventional practice.

The firing mechanism 12 comprises an outer steel cylinder 26 the front end wall of which contains a breech entry port 24 and within which moves part of a gas spring comprising a hollow piston 28 having a cylindrical piston wall 30 which is closed at its left hand end by a wall 29. The piston has a crown damper 32 and piston seal 34 in the form of an "O" ring behind the piston crown 35.

Within the rear part of the outer cylinder 26 is fixed an inner steel cylinder 36 forming a further part of the gas spring and defining with the outer cylinder 26 an annular clearance 38 within which is received the rear end of the piston wall 30. The inner cylinder 36 is sealed with respect to the bore of the piston 28 at the front end of said cylinder 36 through an "O" ring seal 40 and a lip seal 42.

The lip seal 42 is located in a groove 42A in the protruding end of a short tube 44, the inner end of which is secured by Loctite adhesive in the end of the cylinder 36.

The lip seal is undercut on its face which opens towards the space within the hollow piston 28 so that, when a charge of compressed gas is introduced into the space within the hollow piston 28 and the inner cylinder 36, in a manner to be described, such pressure biasses the peripheral lip of the seal against the inner bore of the piston 28.

It is to be noted that, when the gun is cocked, the piston 28 is moved relatively slowly to the right in the drawings while the lip seal 42 remains stationary. This relatively slow movement over the lip seal does not give rise to any difficulties. Nor, when the gun is fired and the piston 28 is moving at high speed to the left, is there any difficulty with the seal 42 since at that time the seal can act as a trailing seal in relation to the bore of the piston. Thus during cocking and firing the lip seal 42 provides an effective and permanent seal, containing the charge of compressed gas against escape.

At its rear end, the inner cylinder 36 is closed by a tailpiece 46 which also serves to close the rear end of the outer cylinder 26. Thus, said tailpiece 46 mates within the rear end of the outer cylinder 26 and is fixed in position by three locking screws 48 which are sealed in position by use of a metal bonding adhesive, such as that known by the Trade Mark Loctite, at the time the screws are inserted and tightened.

Figure 2:
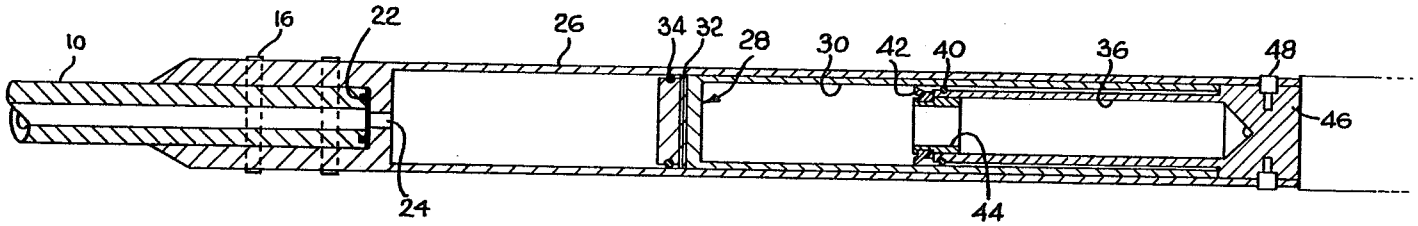
FIG. 2 shows the mechanism in horizontal cross-section.
Figure 3:
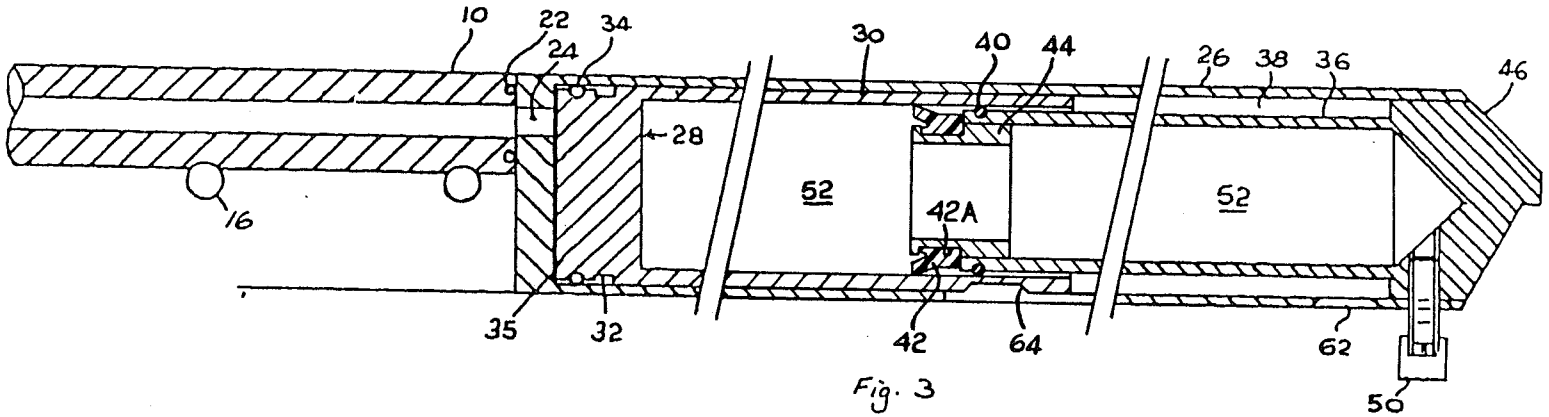
FIGS. 3 and 4 show the mechanism, in the uncocked condition and to an enlarged scale, respectively in vertical and horizontal cross-sections.

By means of a Schraeder type valve 50 (see FIG. 3) in the rear closure 46, a charge of high pressure gas, e.g. air or carbon dioxide, or an inert gas which has no effect on the lip seal 42, can be forced into the sealingly closed variable volume chamber 52 defined by the communicating interiors of the inner cylinder 36 and the hollow piston 28. When the mechanism is uncocked (see FIGS. 3 and 4), the piston 28 is disposed in its most forward position and the chamber 52 has a maximum volume. When the mechanism is cocked (see FIGS. 1, 2 and 5), the piston 28 is in its most rearward position and the chamber 52 has a minimum volume, which is about two thirds of its maximum volume in the uncocked condition.

The mechanism 12 is cocked when the breech 18 is opened by pivoting the barrel 10. A cocking lever mechanism 54 driven by the pivoting barrel moves rearwardly, in turn pushing the piston 28 rearwardly through the intermediary of a lug 56 on said piston which projects through a longitudinal slot 58 in the outer cylinder 26. When the piston 28 reaches its most rearward position, in which the charge of gas in the chamber 52 is under very high compression, it is latched in position by a spring loaded trigger mechanism 60 having a sear which engages through a slot 62 in the outer cylinder into a recess 64 in the wall 30 of the piston. The air rifle is now ready to be fired by pulling the trigger 66.

When the rifle is fired by pulling the trigger, the piston latch or sear is released, and the piston 28 is driven rapidly forward under the pressure of the highly compressed gas in the chamber 52. Air in the outer cylinder 26 in front of the piston 28 is increasingly compressed until it exceeds a threshold which fires the pellet out of the breech along the barrel.

Figure 4:
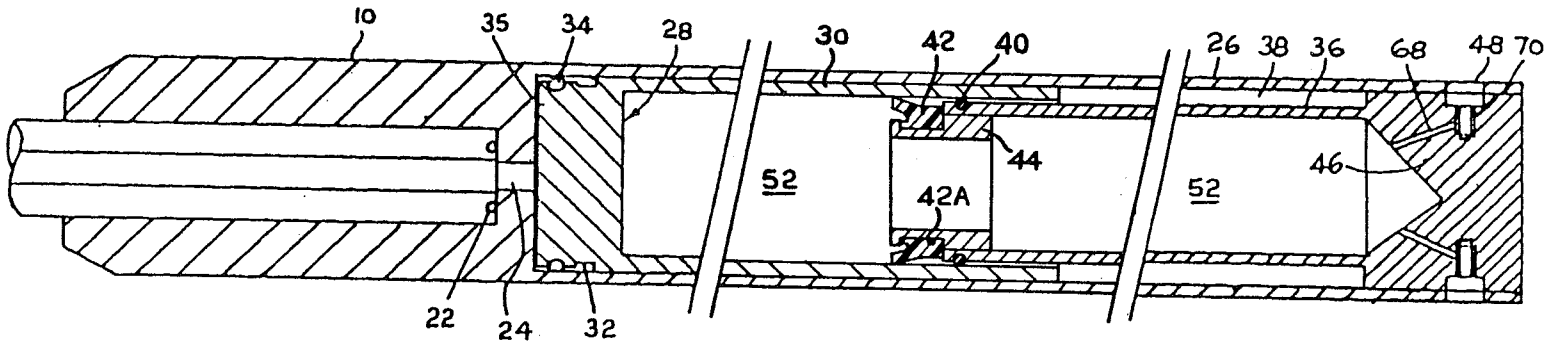
Figure 5:
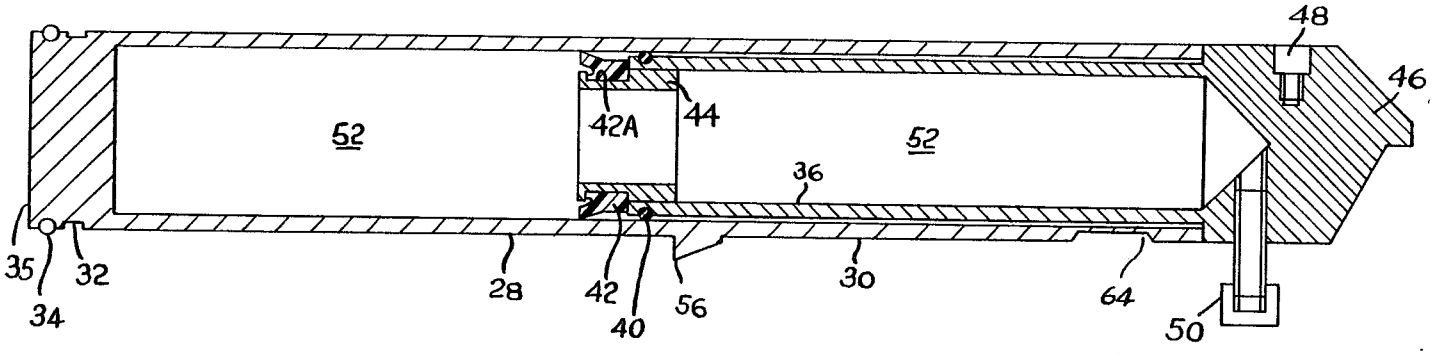
FIG. 5 shows the gas spring of the mechanism in isolation, in the cocked condition and to an enlarged scale, in cross-section.

An important further feature of the invention is, for convenience, illustrated in FIG. 4. Air escape passages 68 are provided in the tailpiece 46 of the inner cylinder 26 communicating the interior of the latter, i.e. the chamber 52, with each of screwholes 70 into which screw the locking screws 48 which fix the inner cylinder in position. Thus, whenever any such screw 48 is removed preparatory to cleaning or servicing the firing mechanism, the high pressure charge of gas in the chamber 52 is at once released, before the inner cylinder 36 is removable.

It will be appreciated that the aim of the invention is to provide a practical arrangement which enables the rifle to be given a virtually permanent charge of gas in the chamber 52 during manufacture, which charge of gas only has to be renewed (from a suitable high pressure gas cylinder or the like) after the rifle has been deliberately dismantled for maintenance or the like. The charge of high pressure gas acts as a gas spring, and is not a consumable gas charge as is employed in some gas operated air rifles. Within this context, various modifications of the above-described arrangement are possible within the scope of the invention.

In order to ensure reliable sealing and operation it has been found preferable to include a small quantity of liquid in the inner piston, typically an oil such as that employed in the hydraulic vehicle braking systems and the like. The liquid is poured into the inner cylinder 30 during assembly and is effectively sealed in when the latter is fitted over the static "piston" 36.

A smear of silicone based grease or similar is trapped between the two seals 42 and 40 for the life of the device.

A smear of bearing grease such as molybdenum disulphide or graphite based grease or similar is applied to the eternal surface of the hollow piston during assembly.

The "O" ring 40 prevents any mixing of the two different greases.

While the invention has been shown as applied to an air rifle it will be appreciated that it could be applied to other kinds of air weapons.

What is claimed is:

1. An air weapon for launching a projectile by means of a charge of compressed air, said weapon comprising:

a barrel from which to launch said projectile;

an outer cylinder with an internal bore, said outer cylinder having a closed end and an open end, said open end being in communication with said barrel;

an inner cylinder with an internal bore and an outer wall, said inner cylinder located within said outer cylinder with a coaxial clearance, said inner cylinder having a closed end and an open end, said open end located between said outer wall of said inner cylinder and said internal bore of said outer cylinder of said inner cylinder being relatively closer to said barrel then said closed end of said inner cylinder;

a piston axially movably located within said outer cylinder between a cocked and an uncocked position, said piston having a piston crown and a cylindrical piston wall, said piston wall having an inner surface closed at the crown end of said piston and forming a piston interior, said piston interior being open at the end thereof opposite said crown end, said piston interior being in communication with the internal bore of said inner cylinder via said open end of said inner cylinder, said piston cooperating with said bore of said outer cylinder to form a piston and cylinder device capable of compressing a charge of air to expel said projectile, said piston wall extending axially into said coaxial clearance and being axially movable therein;

first annular sealing means between said piston wall inner surface and the outer wall of said inner cylinder to define a gas-tight expansion chamber defined by said internal bore of said inner cylinder and said piston interior, said expansion chamber being capable of being filled permanently with a charge of compressed gas; and cocking means for retracting said piston toward said inner cylinder into said cocked position to compress gas in said expansion chamber, whereby upon release of said cocking means, said charge of compressed gas acts as a gas spring to force said piston into said uncocked position thereby compressing air before said piston crown to launch from said barrel said projectile.

2. An air weapon as claimed in claim 1, in which said expansion chamber is adapted to hold said gas at a substantially higher pressure than atmosphere when said piston is in said uncocked position.

3. An air weapon as claimed in claim 1, including second annular sealing means carried by said piston crown to create a relatively movable seal between said bore of said outer cylinder and said piston crown.

4. An air weapon as claimed in claim 3, in which the first and second annular means define between them an intermediate volume which is adapted to be at atmospheric pressure in both said cocked and uncocked positions.

5. An air weapon as claimed in claim 1, in which said first sealing means comprises an annular lip seal which is arranged to be biased by pressure in said expansion chamber to prevent escape of gas therefrom.

6. An air weapon as claimed in claim 1, including a sear and a latching recess formed on said piston, said sear being engageable with said latching recess in said cocked position, and triggering means for releasing said piston from said sear to cause said piston to be propelled to said uncocked position.

7. An air weapon as claimed in claim 1, in which said cocking means comprise a cocking lever attached to said barrel and said piston and operable, when said weapon is opened at said barrel, to urge said piston to said cocked position.

8. An air weapon as claimed in claim 1, in which said first annular sealing means comprise an O-ring.

9. An air weapon as claimed in claim 1, including a refill valve which is in communication with said closed end of said inner cylinder such that said expansion chamber is chargeable with a gas under pressure.

10. An air weapon as claimed in claim 1, in which said closed end of said inner cylinder and said closed end of said outer cylinder are of a unitary construction.

11. An air weapon as claimed in claim 10, including locking screws and complementary screw holes in said closed end of said inner cylinder, said screws securing said inner cylinder to said outer cylinder through said screw holes, said screw holes communicating said expansion chamber to atmosphere when one of said screws is removed.

* * * * *